US007054458B2

(12) United States Patent
Ito et al.

(10) Patent No.: US 7,054,458 B2
(45) Date of Patent: May 30, 2006

(54) HOLDER USED IN THE MICROPHONE UNIT

(75) Inventors: Motoaki Ito, Shizuoka (JP); Yoshiaki Tsukiji, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 0 days.

(21) Appl. No.: 10/743,020

(22) Filed: Dec. 23, 2003

(65) Prior Publication Data

US 2004/0146171 A1 Jul. 29, 2004

(30) Foreign Application Priority Data

Dec. 24, 2002 (JP) ..... P2002-371543

(51) Int. Cl.
*H04R 25/00* (2006.01)

(52) U.S. Cl. ..... 381/355; 381/174; 381/368; 381/409

(58) Field of Classification Search ..... 381/113, 381/116, 355, 361, 368, 369, 170, 174, 191, 381/409, 410; 439/86, 91, 856, 500
See application file for complete search history.

(56) References Cited

U.S. PATENT DOCUMENTS

| | | | | |
|---|---|---|---|---|
| 4,456,796 | A * | 6/1984 | Nakagawa et al. | 381/191 |
| 5,788,516 | A * | 8/1998 | Uggmark | 439/86 |
| 6,217,349 | B1 * | 4/2001 | Konno | 439/91 |
| 6,549,636 | B1 * | 4/2003 | Fujimoto et al. | 381/368 |

FOREIGN PATENT DOCUMENTS

| | | |
|---|---|---|
| EP | 0 880 299 A1 | 11/1998 |
| JP | 3244448 B2 | 9/1998 |

* cited by examiner

*Primary Examiner*—Huyen Le
(74) *Attorney, Agent, or Firm*—Sughrue Mion, PLLC

(57) ABSTRACT

In a microphone having a microphone body stored in a substantially cylindrical metal casing, the casing per se is formed as a ground terminal while a plus terminal is disposed in the center of a lower end surface of the microphone body. A holder is formed to have a bottom wall portion extending from a lower end portion of the holder to a lower end surface of the microphone. An outer circumferential edge portion and a center portion of the bottom wall portion are made of electrically conductive rubber so as to serve as first and second electrically conductive portions electrically connected to the two terminals respectively. Sufficient contact areas of the two electrically conductive portions with electrically conductive patterns of an external board is obtained while a sufficient gap is ensured between the two electrically conductive portions.

7 Claims, 7 Drawing Sheets

HOLDER USED IN THE MICROPHONE UNIT

BACKGROUND OF THE INVENTION

1. Field of the Invention

The present invention relates to a microphone unit having a microphone held in a rubber holder, and to the holder used in the microphone unit.

2. Description of the Related Art

Japanese Patent No. 3,244,448 discloses a small-size microphone mounted in a cellular phone. The microphone has an outer circumferential surface substantially cylinder-shaped, and a lower end surface on which a ground terminal and a plus terminal are disposed. The ground and plus terminals are provided so as to be electrically connected to electrically conductive patterns on a board (hereinafter referred to as "external board") in the cellular phone.

The microphone is mounted on the external board while the microphone is held in a rubber holder so as to be substantially cylindrically covered with the rubber holder for the purpose of prevention of sound leakage, positioning, etc.

Reduction in microphone size has advanced in recent years, and a microphone having a diameter of not larger than 3 mm has been developed. In such an ultra small microphone, a space for arranging a ground terminal and a plus terminal has been hardly ensured on a lower end surface of the microphone.

In order to mount the microphone on the board without consciousness of the directivity of the microphone, it is preferable that a terminal arrangement called bull's eye (i.e., a terminal arrangement in which the ground terminal and the plus terminal are arranged concentrically) is adopted. It is however difficult to ensure a sufficient gap between the two terminals if the outer diameter of the microphone becomes smaller than a certain value. This causes a problem that steady electric connection of the terminals to electrically conductive patterns of the external board respectively can be hardly attained when the microphone is mounted on the external board.

Therefore, in the conventional ultra small microphone, one end portion of a lead wire need be soldered to each of the ground terminal and the plus terminal in advance, and the other end portion of the lead wire need be soldered to each of electrically conductive patterns of the external board when the microphone is mounted on the external board. This causes a problem that efficiency in mounting the microphone is very low.

SUMMARY OF THE INVENTION

An object of the present invention is to provide a microphone unit that enables a microphone to be mounted on an external board easily and steadily even in the case where the microphone is ultra small, and to provide the microphone and a holder used in the microphone unit.

The present invention achieves the object by providing a microphone having a ground terminal of an improved structure and providing a holder of an improved structure which holds the microphone.

The present invention provides a microphone unit comprising: a microphone having an outer circumferential surface substantially cylinder-shaped; and a rubber holder for holding the microphone while substantially cylindrically covering the microphone; wherein the microphone comprises a substantially cylindrical metal casing, a microphone body received in the casing, a ground terminal constituted by the casing per se, and a plus terminal disposed in a lower end surface of the microphone body; and the holder comprises a bottom wall portion extending from a lower end portion of the holder to a lower end surface of the microphone, the bottom wall portion having a first electrically conductive portion constituted by at least one part of an outer circumferential edge portion of the bottom wall portion and made of electrically conductive rubber so as to be electrically connected to the ground terminal, and a second electrically conductive portion constituted by a predetermined region of the bottom wall portion distant from the first electrically conductive portion toward the inner circumferential side and made of electrically conductive rubber so as to be electrically connected to the plus terminal.

The present invention also provides a rubber holder for holding a microphone having an outer circumferential surface substantially cylinder-shaped while substantially cylindrically covering the microphone, the holder comprising: a bottom wall portion extending from a lower end portion of the holder to a lower end surface of the microphone; wherein at least one part of an outer circumferential edge portion of the bottom wall portion and a predetermined region of the bottom wall portion distant from the at least one part of an outer circumferential edge portion of the bottom wall portion toward the inner circumferential side are made of electrically conductive rubber.

The "bottom wall portion" is not limited to a particular structure as far as it extends from the lower end portion of the holder to the lower end surface of the microphone. The "bottom wall portion" may be formed not to entirely block the lower end opening of the holder.

The "holder" is not limited to a particular structure as far as it covers the microphone substantially cylindrically. Although the first and second electrically conductive portions of the "holder" are made of electrically conductive rubber, regions of the holder except the first and second electrically conductive portions may be entirely made of general electrically insulating rubber or may include portions made of electrically conductive rubber as far as the first and second electrically conductive portions are electrically insulated from each other.

According to the microphone unit of the present invention which includes a microphone having an outer circumferential surface substantially cylinder-shaped and a rubber holder for holding the microphone while substantially cylindrically covering the microphone, the microphone includes a substantially cylindrical metal casing, a microphone body received in the casing, a ground terminal constituted by the casing per se, and a plus terminal disposed in a lower end surface of the microphone body. On the other hand, the holder includes a bottom wall portion extending from a lower end portion of the holder to a lower end surface of the microphone, the bottom wall portion having a first electrically conductive portion constituted by at least one part of an outer circumferential edge portion of the bottom wall portion and made of electrically conductive rubber so as to be electrically connected to the ground terminal, and a second electrically conductive portion constituted by a predetermined region of the bottom wall portion distant toward the inner circumferential side from the first electrically conductive portion and made of electrically conductive rubber so as to be electrically connected to the plus terminal. This structure has the following advantages.

Since the casing per se of the microphone is formed as the ground terminal while the plus terminal is disposed in the lower end surface of the microphone body, a sufficient gap can be ensured between the two terminals even in the case where the terminal arrangement for an ultra small microphone is provided as a bull's eye arrangement.

Further, since the bottom wall portion of the holder is provided so that at least one part of the outer circumferential edge portion of the bottom wall portion is made of electrically conductive rubber to form a first electrically conductive portion electrically connected to the ground terminal while a predetermined region of the bottom wall portion distant toward the inner circumferential side from the first electrically conductive portion is made of electrically conductive rubber to form a second electrically conductive portion electrically connected to the plus terminal, contact areas of the first and second electrically conductive portions with electrically conductive patterns of an external board can be kept sufficient while a sufficient gap can be ensured between the first and second electrically conductive portions. Accordingly, the respective terminals of the microphone can be steadily electrically connected to the electrically conductive patterns of the external board without necessity of lead wires used in the conventional art.

As described above, in accordance with the invention, the microphone can be mounted on the external board easily and steadily even in the case where the microphone is ultra small.

Although the shape of the holder is not limited to a particular shape as described above, when the holder is formed to have an outer circumferential surface substantially cylinder-shaped, the first and second electrically conductive portions of the holder can be formed in the bull's eye arrangement. Accordingly, electrical connection of the first and second electrically conductive portions to the electrically conductive patterns of the external board can be attained steadily even in the case where the electrically conductive patterns of the external board are not arranged concentrically.

The first electrically conductive portion of the holder is brought into contact with the casing to thereby be electrically connected to the ground terminal. The form of contact is not particularly limited. For example, the first electrically conductive portion may be brought into contact with the casing from the lower side, or the first electrically conductive portion may be brought into contact with the casing from the outer circumferential side, or the first electrically conductive portion may be brought into contact with the casing from the lower side and the outer circumferential side.

When the form in which the first electrically conductive portion is brought into contact with the casing from the lower side is adopted, the amount of use of electrically conductive rubber more expensive than electrically insulating rubber can be reduced. When the form in which the first electrically conductive portion is brought into contact with the casing from the outer circumferential side is adopted, a larger gap can be easily formed between the first and second electrically conductive portions. When the form in which the first electrically conductive portion is brought into contact with the casing from the lower side and the outer circumferential side is adopted, electrical connection between the first electrically conductive portion and the ground terminal can be attained more steadily.

DETAILED DESCRIPTION OF THE PREFFERED EMBODIMENTS

The present invention will be described below in detail with reference to the accompanying drawings.

Figure 1:
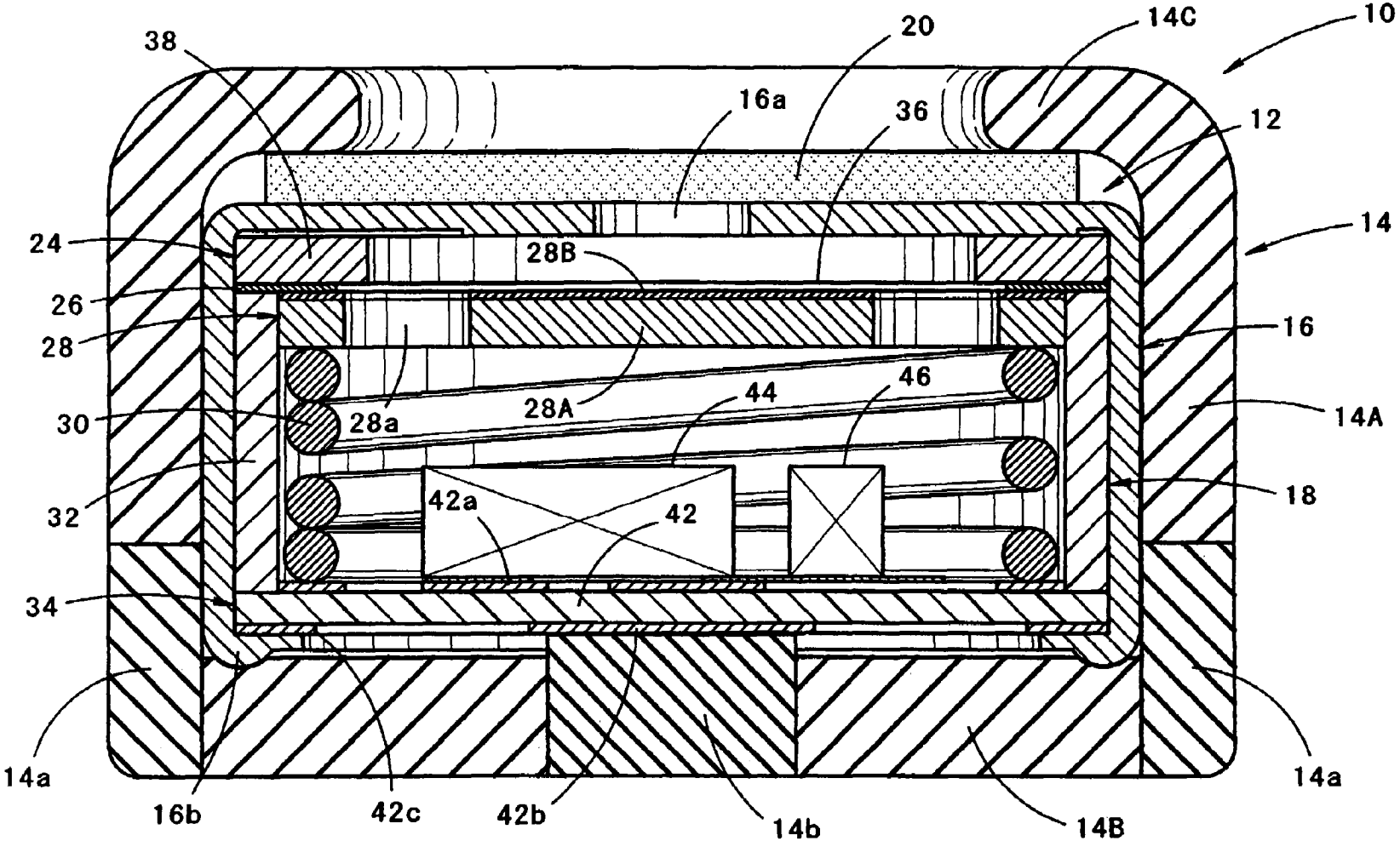
FIG. 1 is a side sectional view of a microphone unit according to an embodiment of the invention in the case where the microphone unit is disposed so as to face upward.
Figure 2:
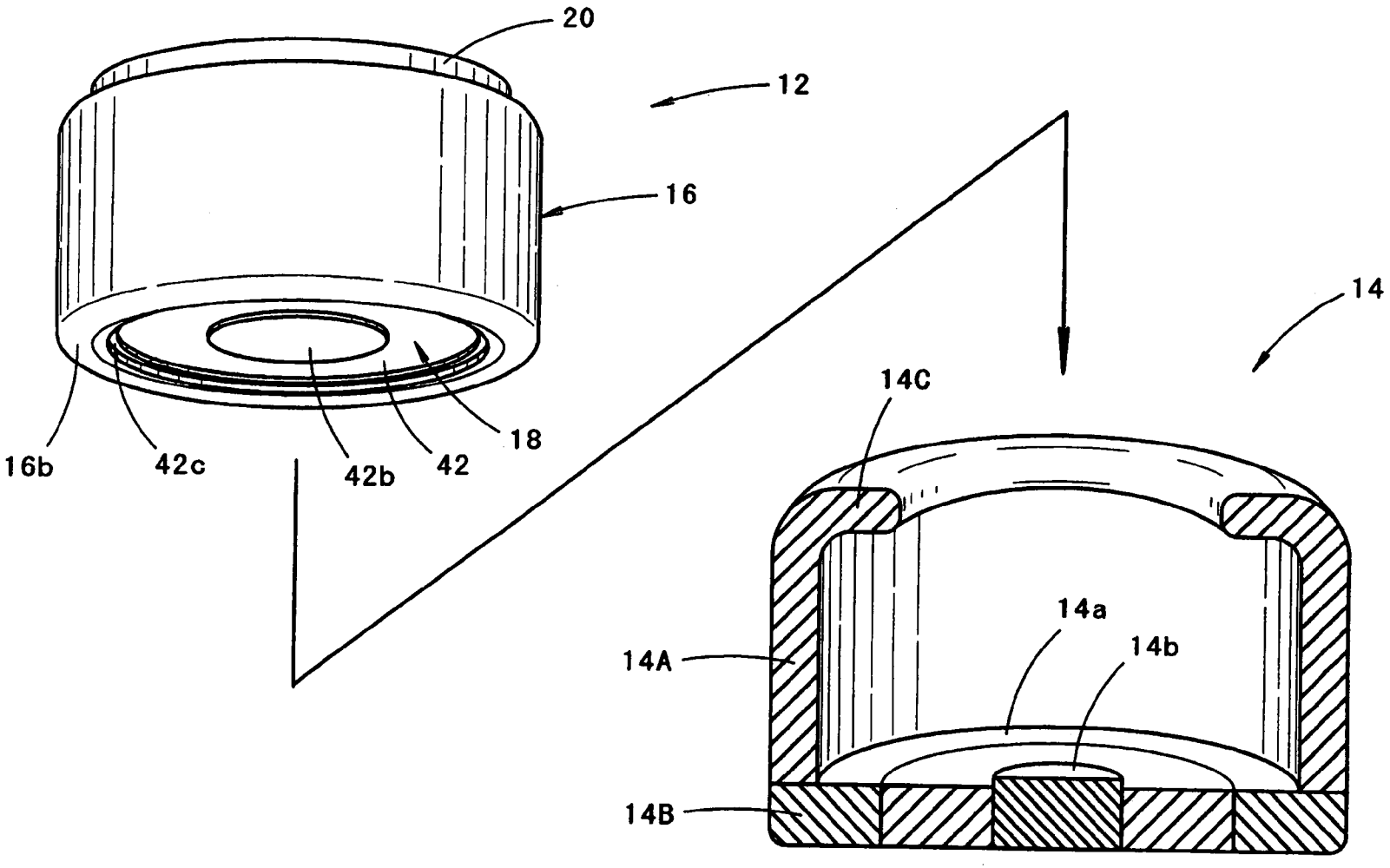
FIG. 2 is an exploded perspective view of the microphone unit.

FIG. 1 is a side sectional view of a microphone unit according to an embodiment of the invention in the case where the microphone unit is disposed so as to face upward. FIG. 2 is an exploded perspective view of the microphone unit.

As shown in FIGS. 1 and 2, the microphone unit 10 according to this embodiment includes a microphone 12 having an outer circumferential surface substantially cylinder-shaped, and a rubber holder 14 for holding the microphone 12 so as to cover the microphone 12 substantially cylindrically.

The configuration of the microphone 12 will be described first.

The microphone 12 is an ultra small electret condenser microphone which includes a substantially cylindrical casing 16, a microphone body 18 stored in the casing 16, and a disk-shaped acoustic filter 20 made of non-woven fabric or the like and attached to an upper surface of the casing 16.

The microphone body 18 has a diaphragm subassembly 24, a spacer 26, a back plate 28, a coil spring 30, an insulating bush 32, and an FET (field-effect transistor) board 34.

The casing 16 is made of metal (e.g., aluminum). The outer diameter of the casing 16 is set at about 3 mm. The height of the casing 16 is set at about 1.5 mm. A sound emitting hole 16*a* is formed in an upper end wall of the casing 16. A lower end portion 16*b* of the casing 16 is fixed to an FET board 34 by caulking.

The diaphragm subassembly 24 has a diaphragm 36, and a support ring 38 to which the diaphragm 36 is fixed tensely. The diaphragm 36 has a metal deposited film formed on an upper surface of a circular resin film. The outer diameter of the diaphragm 36 is set at a value nearly equal to the inner diameter of the casing 16. On the other hand, the support ring 38 is made of metal and has an outer diameter nearly equal to the outer diameter of the diaphragm 36.

The spacer 26 is made of a metal thin-plate ring having an outer diameter nearly equal to the inner diameter of the casing 16.

The back plate 28 has a back plate body 28A made of metal, and an electret 28B thermally fusion-bonded to an upper surface of the back plate 28A. A plurality of through-holes 28*a* are formed in the back plate 28. The electret 28B is made of a resin film polarized to obtain a required surface potential (e.g., about −260 V).

In the casing 16, the electret 28B and the diaphragm 36 are arranged opposite to each other with interposition of a required very small gap through the spacer 26 to thereby form a condenser portion.

The insulating bush 32 is a cylindrical member having an outer diameter nearly equal to the inner diameter of the casing 16. The back plate 28 and the coil spring 30 are disposed on an inner circumferential side of the insulating bush 32. The back plate 28 is elastically pressed against the spacer 26 by the coil spring 30.

The FET board 34 has-aboard body 42 having an outer diameter nearly equal to the inner diameter of the casing 16, and an FET chip 44 and a condenser chip 46 mounted on an upper surface of the board body 42. An electrically conductive pattern 42*a* is formed on the upper surface of the board body 42. A circular electrically conductive pattern 42*b* is formed on a center portion of a lower surface of the board body 42. An annular electrically conductive pattern 42*c* is formed on an outer circumferential edge portion of the lower surface of the board body 42. The electrically conductive pattern 42*c* is formed narrowly along a caulking/fixing width on the lower end portion 16*b* of the casing 16.

The FET chip 44 has a gate electrode electrically connected to the back plate 28 through the electrically conductive pattern 42*a* and the coil spring 30, a drain electrode electrically connected to the electrically conductive pattern 42*b* through the electrically conductive pattern 42*a*, and a source electrode electrically connected to the metal deposited film of the diaphragm 36 through the electrically conductive patterns 42*a* and 42*c*, the casing 16 and the support ring 38.

According to this configuration, in the microphone 12 of this embodiment, the casing 16 per se serves as a ground terminal while the electrically conductive pattern 42*b* of the FET board 34 serves as a plus terminal.

Subsequently, the configuration of the holder 14 will be described.

The holder 14 includes a cylindrical tube portion 14A having an inner diameter nearly equal to the outer diameter of the casing 16, a substantially disk-shaped bottom wall portion 14B formed so as to extend from a lower end portion of the tube portion 14A to a lower end surface of the microphone 12, and an annular lip portion 14C formed annularly so as to extend from an upper end portion of the tube portion 14A to an upper end surface of the microphone 12. The microphone 12 is forced into the holder 14 from the upper side to thereby form the microphone unit 10.

The holder 14 is integrally formed by electrically insulating rubber of silicone rubber and electrically conductive rubber of silicone rubber containing gold-plated iron powder particles as a filler.

Specifically, the tube portion 14A and the annular lip portion 14C are made of the electrically insulating rubber. On the other hand, the bottom wall portion 14B has an outer circumferential edge portion and a center portion made of the electrically conductive rubber, and an annular portion located between the outer circumferential edge portion and the center portion and made of the electrically insulating rubber. The outer circumferential edge portion of the bottom wall portion 14B forms a first electrically conductive portion 14*a* coming into contact with the lower end portion 16*b* of the casing 16 from the lower side so as to be electrically connected to the ground terminal of the microphone 12. The center portion of the bottom wall portion 14B forms a second electrically conductive portion 14*b* coming into contact with the electrically conductive pattern 42*b* of the FET board 34 from the lower side so as to be electrically connected to the plus terminal of the microphone 12.

The first electrically conductive portion 14*a* is formed so that an upper surface of the first electrically conductive portion 14*a* is on the same plane with an upper surface of the bottom wall portion 14B in a range of from the position of an outer circumferential surface of the tube portion 14A to a position far inward by a predetermined distance from an inner circumferential surface of the tube portion 14A. On the other hand, the second electrically conductive portion 14*b* is formed so that an upper surface of the second electrically conductive portion 14*b* protrudes upward by a predetermined distance from an upper surface of the other portion of the bottom wall portion 14B. When the second electrically conductive portion 14*b* is formed in this manner, the second electrically conductive portion 14*b* can be surely brought into contact with the electrically conductive pattern 42*b* though the position of the electrically conductive pattern 42*b* of the FET board 34 is displaced slightly upward from the position of the lower end portion 16*b* of the casing 16.

Figure 3:
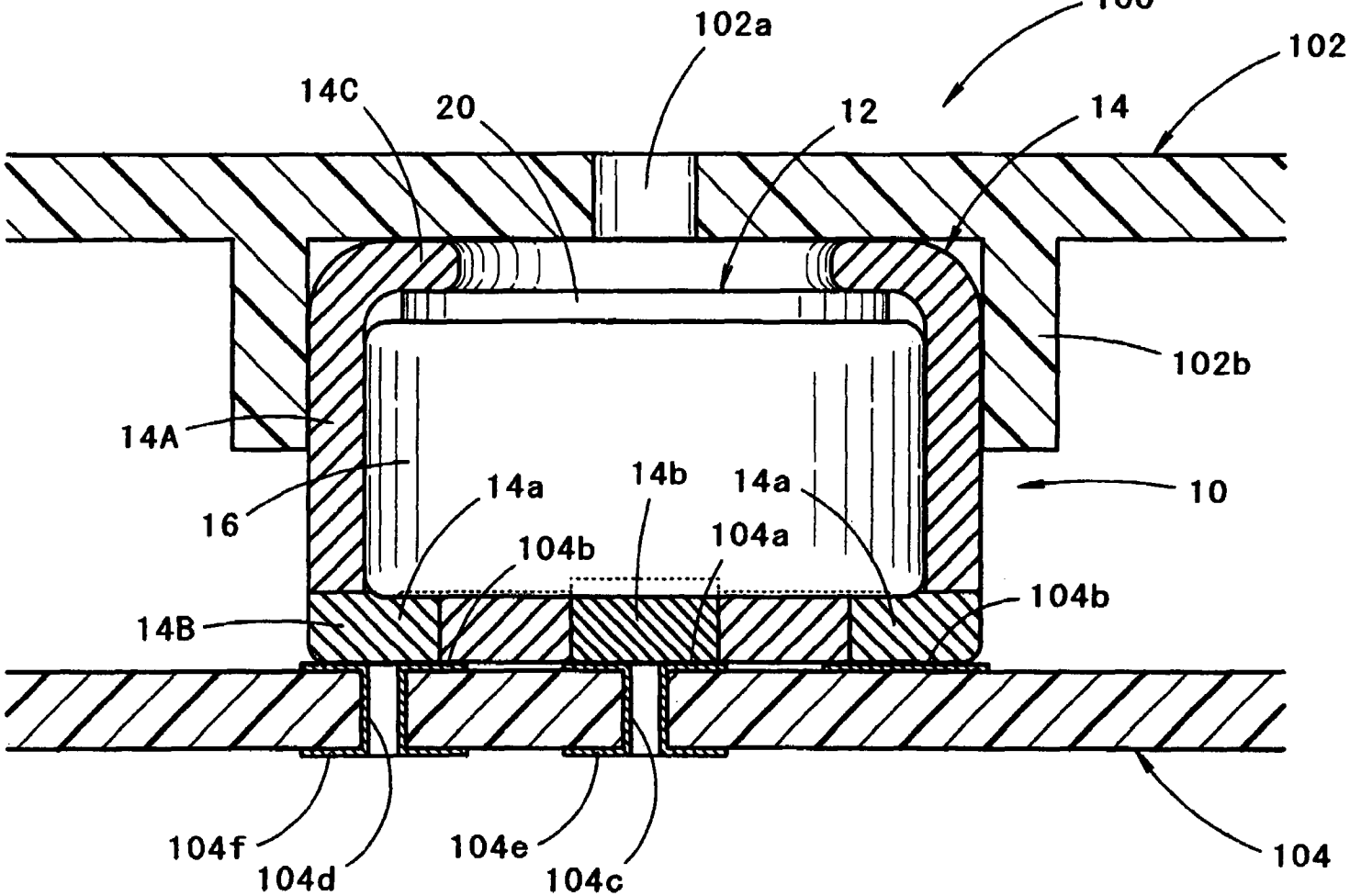
FIG. 3 is a side sectional view showing important part of a cellular phone in which the microphone unit is mounted.

FIG. 3 is a side sectional view showing important part of a cellular phone 100 in which the microphone unit 10 according to this embodiment is mounted.

As shown in FIG. 3, a sound collecting hole 102*a* is formed in a predetermined position of an upper casing 102 of the cellular phone 100. An annular and cylinder-shaped rib 102*b* with the sound collecting hole 102*a* as its center is formed in an inner surface of the upper casing 102.

An external board 104 (i.e., a board for the cellular phone 100) is provided below the upper casing 102. A circular electrically conductive pattern 104*a* and an annular electrically conductive pattern 104*b* surrounding the electrically conductive pattern 104*a* concentrically are formed on an upper surface of the external board 104. Electrically conductive patterns 104*e* and 104*f* are formed on a lower surface of the external board 104. The electrically conductive patterns 104*a* and 104*b* are connected to the electrically conductive patterns 104*e* and 104*f* through through-holes 104*c* and 104*d* respectively.

In the condition that an upper half of the holder 14 in the microphone unit 10 is embedded in a space portion formed in the annular rib 102*b* of the upper casing 102, the bottom wall portion 14B of the holder 14 is pressed against the upper surface of the external board 104 to thereby put the microphone unit 10 in a predetermined position of the cellular phone 100. On this occasion, the bottom wall portion 14B is provided so that the first electrically conductive portion 14*a* of the bottom wall portion 14B comes into contact with the annular electrically conductive pattern 104*b* while the second electrically conductive portion 14*b* of the bottom wall portion 14B comes into contact with the circular electrically conductive pattern 104*a*.

As described above in detail, the microphone unit 10 according to this embodiment is provided so that the casing 16 per se of the microphone 12 serves as the ground terminal while the electrically conductive pattern 42*b* in the center of the lower end surface of the microphone body 18 serves as the plus terminal. Accordingly, the arrangement of the two terminals can be provided as a bull's eye arrangement in which a sufficient gap is ensured between the two terminals even in the case where the microphone 12 is an ultra small microphone.

That is, in this embodiment, the annular electrically conductive pattern 42*c* formed on the outer circumferential edge portion of the lower surface of the board body 42 need not have the function of the ground terminal if the annular electrically conductive pattern 42*c* is electrically connected to the electrically conductive pattern 42*a* and the casing 16. Accordingly, the annular electrically conductive pattern 42*c* can be formed narrowly along the caulking/fixing width on the lower end portion 16*b* of the casing 16. Thus, a sufficient gap can be ensured between the annular electrically conductive pattern 42*c* and the circular electrically conductive pattern 42*b* formed in the center portion of the board body 42.

Although this embodiment has been described on the case where the electrically conductive pattern 42*a* is electrically connected to the casing 16 through the electrically conductive pattern 42*c*, the invention may be also applied to the case where the electrically conductive pattern 42*a* is electrically connected to the casing 16 directly. In this case, a larger gap can be ensured between the electrically conductive pattern 42*b* and the lower end portion 16*b* of the casing 16 because the electrically conductive pattern 42*c* can be dispensed with.

The holder 14 in the microphone unit 10 according to this embodiment is provided so that the bottom wall portion 14B is formed to extend from the lower end portion of the holder 14 to the lower end surface of the microphone 12. The outer circumferential edge portion of the bottom wall portion 14B is made of electrically conductive rubber so as to serve as the first electrically conductive portion 14*a* electrically connected to the ground terminal. The center portion of the bottom wall portion 14B is made of electrically conductive rubber so as to serve as the second electrically conductive portion 14*b* electrically connected to the plus terminal. Accordingly, contact areas of the first and second electrically conductive portions 14*a* and 14*b* with the electrically conductive patterns 104*b* and 104*a* of the external board 104 can be kept sufficient while a sufficient gap can be ensured between the first and second electrically conductive portions 14*a* and 14*b*. Accordingly, the first and second electrically conductive portions 14*a* and 14*b* can be steadily electrically connected to the electrically conductive patterns 104*b* and 104*a* respectively without necessity of lead wires used in the related art.

As described above, in accordance with this embodiment, the microphone 12 can be mounted on the external board 104 easily and steadily even in the case where the microphone 12 is ultra small.

Particularly in this embodiment, since the first electrically conductive portion 14*a* comes into contact with the casing 16 from the lower side, the amount of use of electrically conductive rubber more expensive than electrically insulating rubber can be reduced.

In the microphone unit 10 according to this embodiment, the first and second electrically conductive portions 14*a* and 14*b* of the holder 14, as well as the ground and plus terminals of the microphone 12, are provided in the form of a bull's eye arrangement. Furthermore, the bull's eye arrangement in the holder 14 is a size larger than the bull's eye arrangement in the microphone 12. Accordingly, the following operation and effect can be obtained.

That is, even in the case where the electrically conductive patterns of the external board 104 are formed so as to be different from the electrically conductive patterns 104*a* and 104*b* arranged concentrically as described in this embodiment, the first and second electrically conductive patterns 14*a* and 14*b* of the holder 14 can be steadily electrically connected to the electrically conductive patterns of the external board 104 if the electrically conductive patterns of the external board 104 correspond to the ground and plus terminals of the microphone 12 having the bull's eye arrangement.

Furthermore, because the first and second electrically conductive portions 14*a* and 14*b* of the holder 14 are provided in the form of a bull's eye arrangement larger in size than the bull's eye arrangement of the microphone 12, the microphone unit 10 can be mounted on a general external board having electrically conductive patterns corresponding to a microphone larger in size than the ultra small microphone 12 without any change in configuration of the external board.

Figure 4:
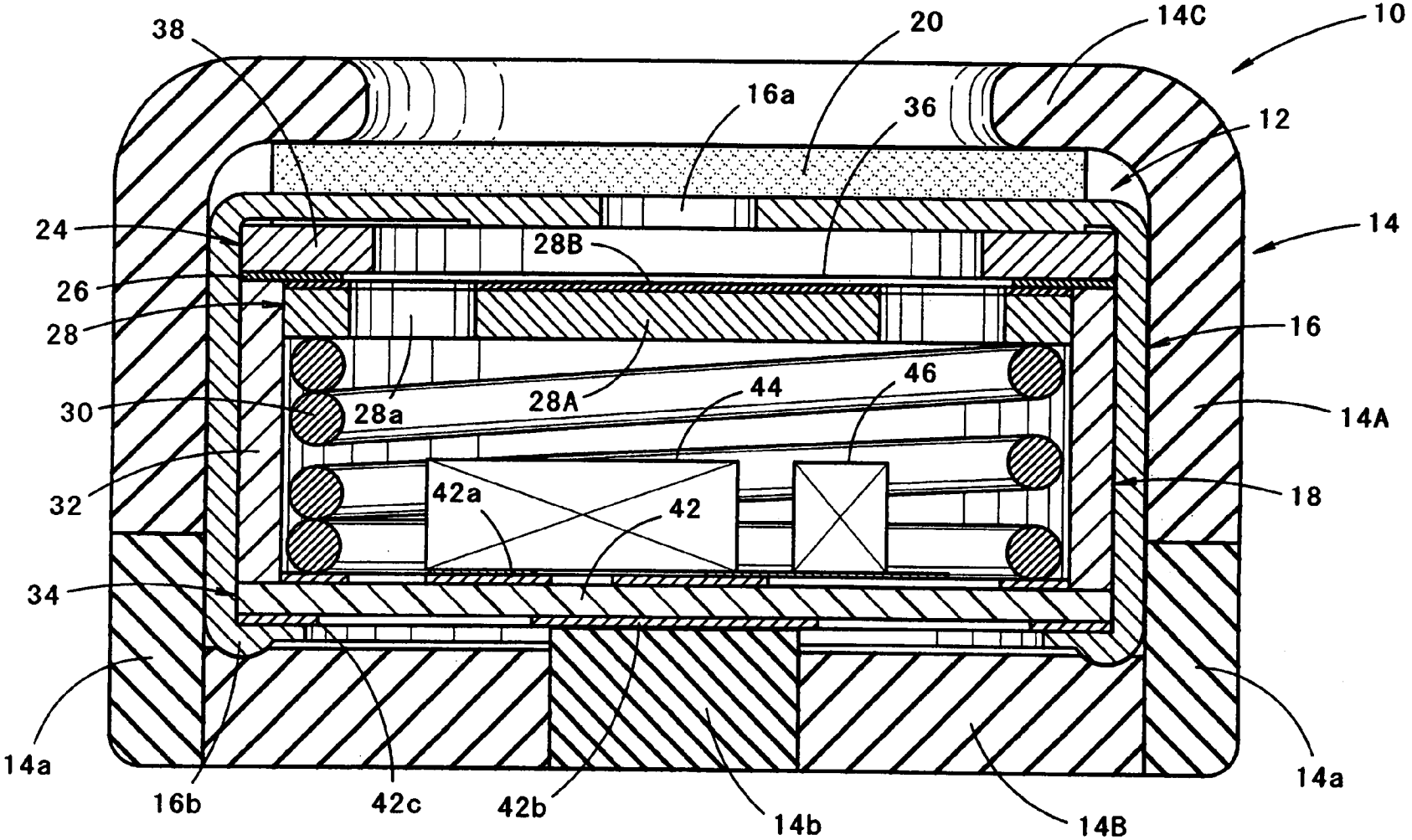
FIG. 4 is a view similar to FIG. 1, showing a first modified example of the microphone unit.
Figure 5:
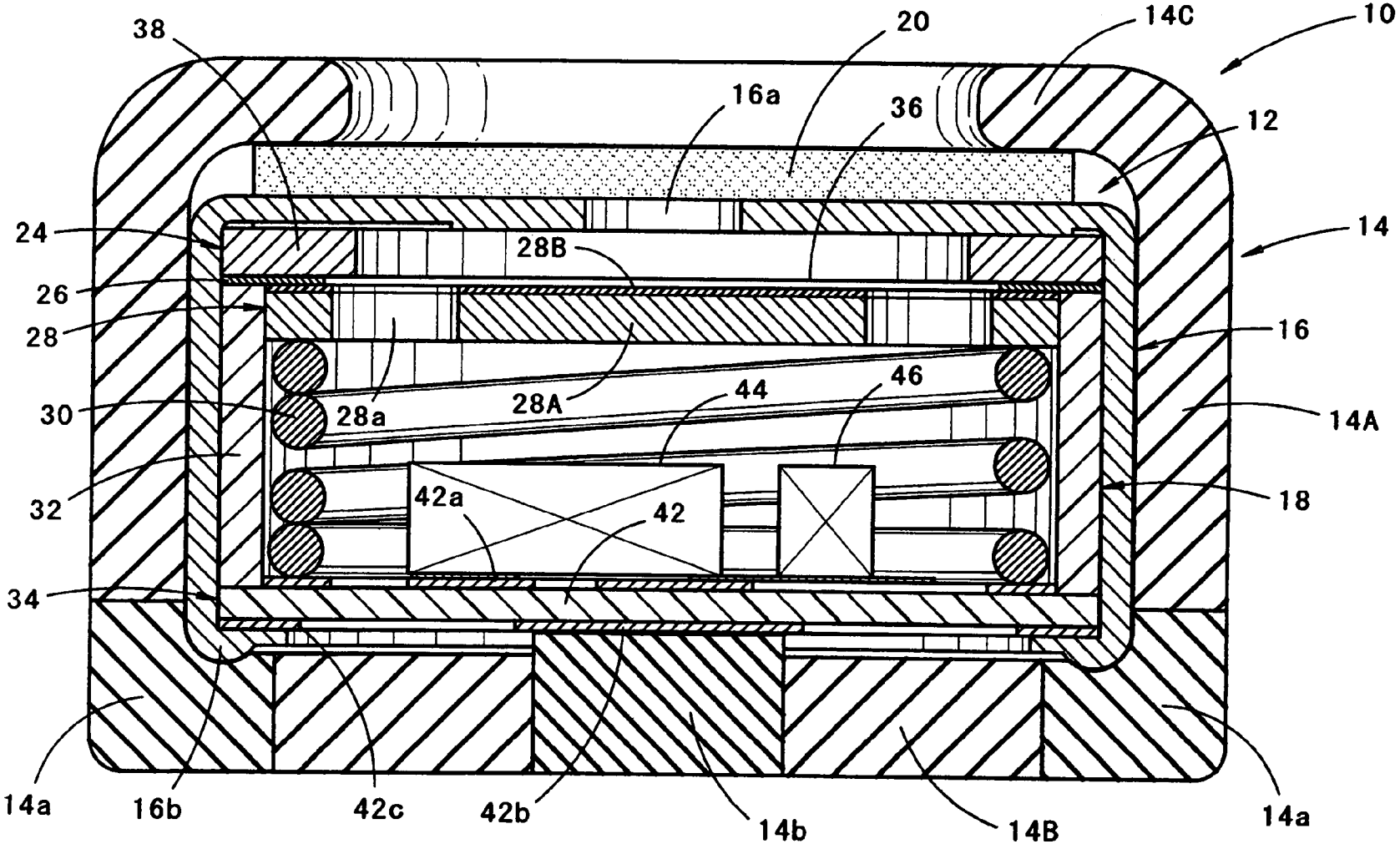
FIG. 5 is a view similar to FIG. 1, showing a second modified example of the microphone unit.

With respect to the first electrically conductive portion 14*a* of the holder 14, a configuration as shown in FIG. 4 or 5 may be used in place of the configuration described in the embodiment.

The first electrically conductive portion 14*a* shown in FIG. 4 is provided in the outer circumferential edge portion of the holder 14 so that an inner circumferential surface of the first electrically conductive portion 14*a* is on the same plane with the inner circumferential surface of the tube portion 14A in a range of from the position of the lower surface of the bottom wall portion 14B to a position far upward by a predetermined distance from the upper surface of the bottom wall portion 14B. The first electrically conductive portion 14*a* comes into contact with the casing 16 from the outer circumferential side. When this configuration is adopted, a larger gap can be formed between the first electrically conductive portion 14*a* and the second electrically conductive portion 14*b*.

On the other hand, the first electrically conductive portion 14*a* shown in FIG. 5 is provided in the outer circumferential edge portion of the holder 14 so as to be formed in an L-shaped. The range of L-shape is from a position of the tube portion 14A far upward by a predetermined distance from the upper surface of the bottom wall portion 14B to a position of the bottom wall portion 14B far inward by a predetermined distance from the inner circumferential surface of the tube portion 14A. The first electrically conductive portion 14*a* comes into contact with the casing 16 from the lower side and the outer circumferential side. When this configuration is adopted, electrical connection between the first electrically conductive portion 14*a* and the ground terminal of the microphone 12 can be attained more steadily.

Figure 6:
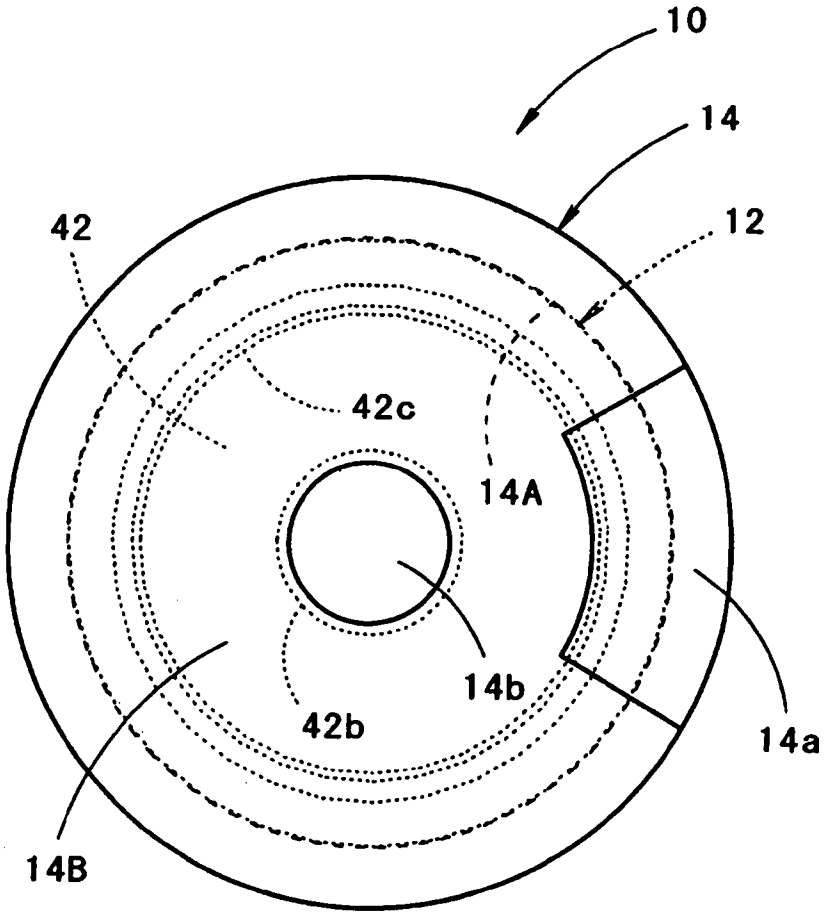
FIGS. 6A and 6B are bottom views showing third and fourth modified examples of the microphone unit.
Figure 6:
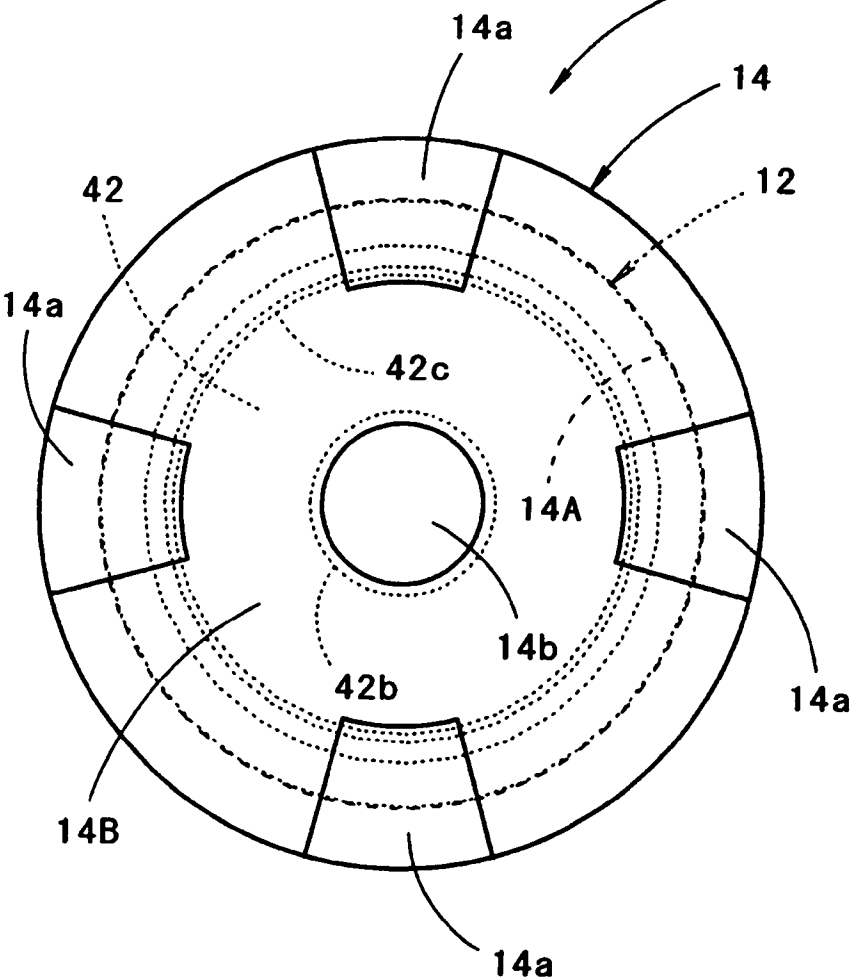

Although the embodiment has been described on the case where the first electrically conductive portion 14*a* is formed on the whole circumference of the outer circumferential edge portion of the bottom wall portion 14B, the invention may be applied to the case where the first electrically conductive portion 14*a* is divided into parts formed at regular intervals in the circumferential direction on the outer circumferential edge portion of the bottom wall portion 14B as shown in FIG. 6A which is a bottom view or to the case where the first electrically conductive portion 14*a* is formed on one place of the outer circumferential edge portion of the bottom wall portion 14B as shown in FIG. 6B which is a bottom view.

Even in the case where the configuration shown in FIG. 6A or 6B is adopted, electrical connection between the first electrically conductive portion 14*a* and the ground terminal can be attained steadily because the casing 16 which forms the ground terminal of the microphone 12 is formed annularly. When the electrically conductive patterns 104*a* and 104*b* of the external board 104 are arranged concentrically as described in the embodiment, electrical connection between the first electrically conductive portion 14*a* and the annular electrically conductive pattern 104*b* can be attained steadily. When this configuration is adopted, the amount of use of expensive electrically conductive rubber can be reduced more.

Although the embodiment has been described on the case where the tube portion 14A of the holder 14 has an outer circumferential surface substantially cylinder-shaped, the invention may be also applied to the case where the outer circumferential surface of the tube portion 14A is formed into another shape.

Figure 7:
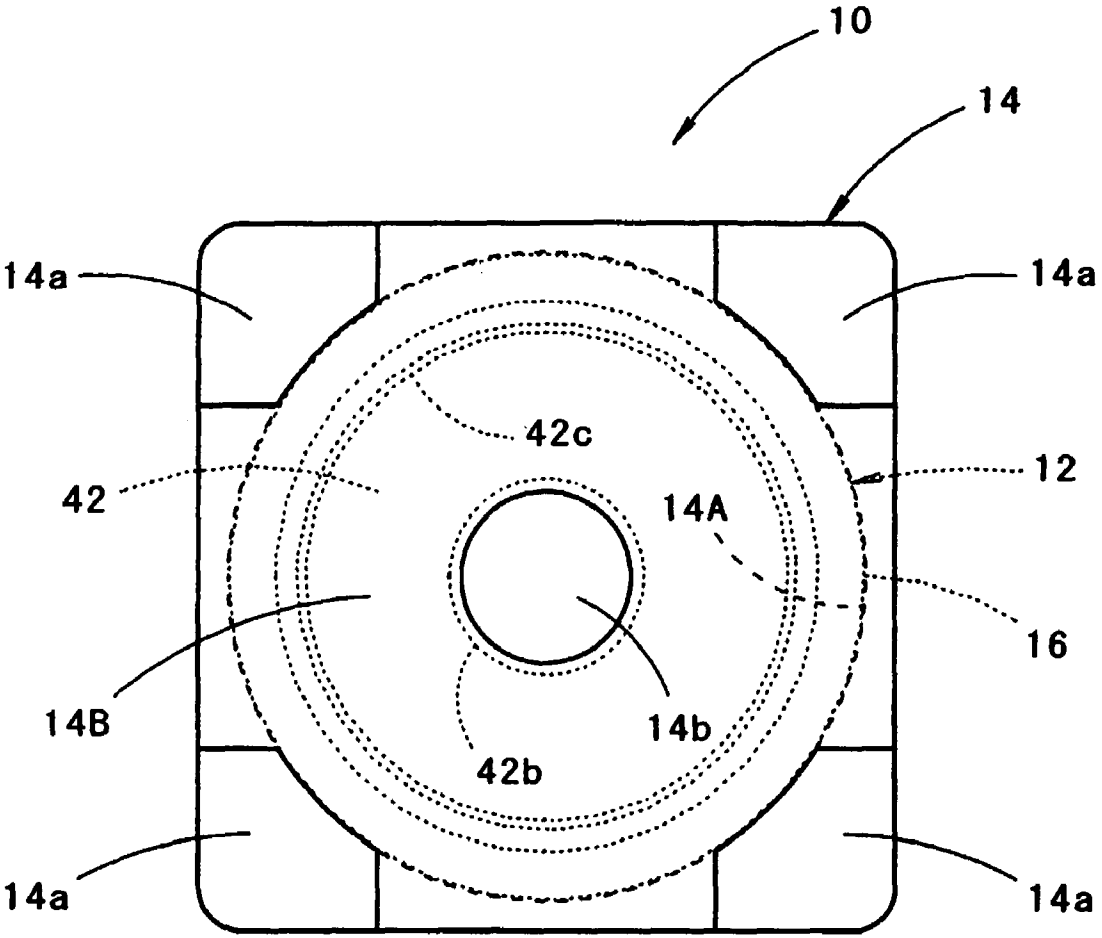
FIG. 7 is a bottom view showing a fifth modified example of the microphone unit.

For example, as shown in FIG. 7 which is a bottom view, the outer circumferential surface of the tube portion 14A may be substantially square-shaped. Incidentally, the holder 14 shown in FIG. 7 is configured so that the first electrically conductive portion 14*a* is divided into four parts formed in four corners of the tube portion 14A respectively. The respective parts of the first electrically conductive portion 14*a* are formed so as to be on the same curved surface with the inner circumferential surface of the tube portion 14A in a range of from the position of the lower surface of the bottom wall portion 14B to a position far upward by a predetermined distance from the upper surface of the bottom wall surface 14B. The respective parts of the first electrically conductive portion 14*a* come into contact with the casing 16 of the microphone 12 from the outer circumferential side.

Although the embodiment has been described on the case where the second electrically conductive portion 14*b* of the holder 14 is formed circularly in the center position of the bottom wall portion 14B, the invention may be applied to the case where the second electrically conductive portion 14*b* is formed in a position slightly displaced from the center position of the bottom wall portion 14B if the position is a position which is distant inward from the first electrically conductive portion 14*a* and where the second electrically conductive portion 14*b* can be electrically connected to the electrically conductive pattern 42*b* which serves as the plus terminal of the microphone 12. The shape, size, etc. of the second electrically conductive portion 14*b* may be selected arbitrarily.

Although the embodiment has been described on the case where the electrically insulating rubber and the electrically conductive rubber used for forming the holder 14 are silicone rubber and silicone rubber containing gold-plated iron powder particles as a filler, the invention may be also applied to the case where other materials are used as the electrically insulating rubber and the electrically conductive rubber respectively.

Although the embodiment has been described on the case where the microphone 12 has an outer circumferential surface substantially cylinder-shaped, the holder 14 in the embodiment maybe applied to the case where the outer circumferential surface of the microphone has another shape (e.g., a rectangular shape in sectional view). Also in this case, the same operation and effect as in the embodiment can be obtained.

Although the embodiment has been described on the case where the microphone 12 is an electret condenser microphone, the invention may be also applied to the case where the microphone 12 is another type microphone. Also in this case, the same operation and effect as in the embodiment can be obtained when the same terminal structure as in the embodiment is adopted.

What is claimed is:

1. A microphone unit comprising:

a microphone having an outer circumferential surface substantially cylinder-shaped; and a rubber holder for holding the microphone while substantially cylindrically covering the microphone;

wherein the microphone comprises a substantially cylindrical metal casing, a microphone body received in the casing, a ground terminal constituted by the casing and a plus terminal disposed in a lower end surface of the microphone body; and the holder comprises a bottom wall portion extending from a lower end portion of the holder to a lower end surface of the microphone, the bottom wall portion having a first electrically conductive portion constituted by at least one pan of an outer circumferential edge portion of the bottom wall portion and made of electrically conductive rubber so as to be electrically connected to the ground terminal, and a second electrically conductive portion constituted by a predetermined region of the bottom wall portion distant from the first electrically conductive portion toward an inner circumferential side and made of electrically conductive rubber so as to be electrically connected to the plus terminal.

2. The microphone unit as claimed in claim 1, wherein the holder has an outer circumferential surface substantially cylinder-shaped.

3. The microphone unit as claimed in claim 2, wherein the first electrically conductive portion comes into contact with the casing from an outer circumferential side.

4. The microphone unit as claimed in claim 1, wherein the first electrically conductive portion comes into contact with the casing from the lower side.

5. The microphone unit as claimed in claim 2, wherein the first electrically conductive portion comes into contact with the casing from the lower side.

6. The microphone unit as claimed in claim 3, wherein the first electrically conductive portion comes into contact with the casing from an outer circumferential side.

7. The microphone unit as claimed in claim 1, wherein the first electrically conductive portion comes into contact with the casing from an outer circumferential side.

* * * * *